United States Patent [19]

Kirkwood et al.

[11] 4,023,457

[45] May 17, 1977

[54] ORGAN STOP SWITCHING SYSTEM

[75] Inventors: George T. Kirkwood, Hillsboro; Patrick M. Castle, Cornelius; John T. Whitney, Scappoose, all of Oreg.

[73] Assignee: Rodgers Organ Company, Hillsboro, Oreg.

[22] Filed: Aug. 21, 1975

[21] Appl. No.: 606,500

[52] U.S. Cl. ..... 84/1.17; 84/1.24; 84/343; 84/DIG. 7

[51] Int. Cl.[2] ..... G10H 3/06

[58] Field of Search ..... 84/1.01, 1.03, 1.11, 84/1.17, 1.24, 343–345, 369–371, 442, DIG. 22

[56] References Cited

UNITED STATES PATENTS

| | | | |
|---|---|---|---|
| 3,084,584 | 4/1963 | Lerio | 84/1.17 |
| 3,098,407 | 7/1963 | Brand et al. | 84/1.11 |
| 3,103,141 | 9/1963 | Adams | 84/1.17 |
| 3,255,294 | 6/1966 | Heytow | 84/1.17 |
| 3,646,241 | 2/1972 | Ott | 84/1.03 |
| 3,674,907 | 7/1972 | Derrt | 84/1.17 |
| 3,735,014 | 5/1973 | Turner | 84/1.24 |
| 3,797,357 | 3/1974 | Thomas et al. | 84/1.01 |
| 3,877,337 | 4/1975 | Obatashi et al. | 84/1.24 |
| 3,910,149 | 10/1975 | Obatashi | 84/1.24 |

*Primary Examiner*—L. T. Hix
*Assistant Examiner*—Vit W. Miska
*Attorney, Agent, or Firm*—Klarquist, Sparkman, Campbell, Leigh, Hall & Whinston

[57] ABSTRACT

The stop control for an organ console comprises a panel including groups of touch sensitive switches disposed in pairs with an adjacent indicating lamp, wherein the switches of a pair respectively actuate and deactuate a given stop while the lamp indicates whether the stop is actuated. The switches of a pair are connected to set and reset terminals of a latching circuit which provides an output for energizing the indicating lamp and for controlling appropriate stop circuitry in the organ. The touch sensitive switches are disposed in groups according to the organ manual or function to which the corresponding stops pertain. A general cancel switch returns the various latching circuits to a reset condition. A transposer control circuit includes a plurality of switches and adjacent indicating lamps wherein the depression of a particular switch operates a latching circuit and resets other latching circuits associated with the transposer.

8 Claims, 5 Drawing Figures

ORGAN STOP SWITCHING SYSTEM

BACKGROUND OF THE INVENTION

This invention relates to an organ stop switching system and more particularly to such a system which is compact and inexpensive.

Usually the stops of an organ are operated by a plurality of stop tablets or draw knobs which are moved from one physical position to another to maintain a particular stop selection. The operational condition of the stops can be determined by observing the physical location of the tablets or draw knobs. This arrangement, while having the advantage of traditional appearance, is nonetheless somewhat bulky, expensive and cumbersome in operation.

SUMMARY OF THE INVENTION

According to the present invention, a stop control system for an organ includes a plurality of latching circuits associated respectively with individual organ stops and adapted to energize circuitry for affecting the tonal quality of the organ. A plurality of touch sensitive switches for operating the latching circuits are included in a panel adapted for mounting on the organ console, and the touch sensitive switches are disposed in groups associated with given organ manuals or functions. Within the groups, the switches are disposed in pairs connected respectively for setting and resetting the corresponding latching circuit which operates a designated organ stop and which controls an indicating lamp disposed in proximity to the pair of touch sensitive switches employed for operating the latching circuit, thereby indicating to the organist the condition of the particular stop, Preferably, a cancel circuit is employed for simultaneously switching the latching circuits associated with the given group of switches to a given condition, e.g. a reset condition. The compact system according to the present invention permits the accommodation of a greater number of stops on a given organ console.

In accordance with a preferred embodiment, a transposer control means is disposed on the same panel wherein such transposer control means includes a plurality of second latching circuits and a plurality of further touch sensitive switches for operating the same, each having an associated indicating lamp. The circuit is connected for deenergizing all but one of the transposer latching circuits such that when depression of one of the further touch sensitive switches selects a given latching circuit, the remaining latching circuits are switched to a reset condition. Also, a predetermined latching circuit, e.g. associated with "zero" transposition, is automatically selected upon energization of the organ.

It is accordingly an object of the present invention to provide an improved organ stop switching system.

It is another object of the present invention to provide an improved organ stop switching system which is compact and inexpensive, allowing the accommodation of a greater number of stops in a given organ console.

It is another object of the present invention to provide an improved organ stop switching system which is easy to operate and wherein the stop positions are readily observable.

It is a further object of the present invention to provide an improved organ stop switching system wherein the stops can be returned as a group to a given position.

It is another object of the present invention to provide an organ stop switching system of improved appearance.

The subject matter which we regard as our invention is particularly pointed out and distinctly claimed in the concluding portion of this specification. The invention, however, both as to organization and method of operation, together with further advantages and objects thereof, may best be understood by reference to the following description taken in connection with the accompanying drawings wherein like reference characters refer to like elements.

DRAWINGS

DETAILED DESCRIPTION

Figure 1:
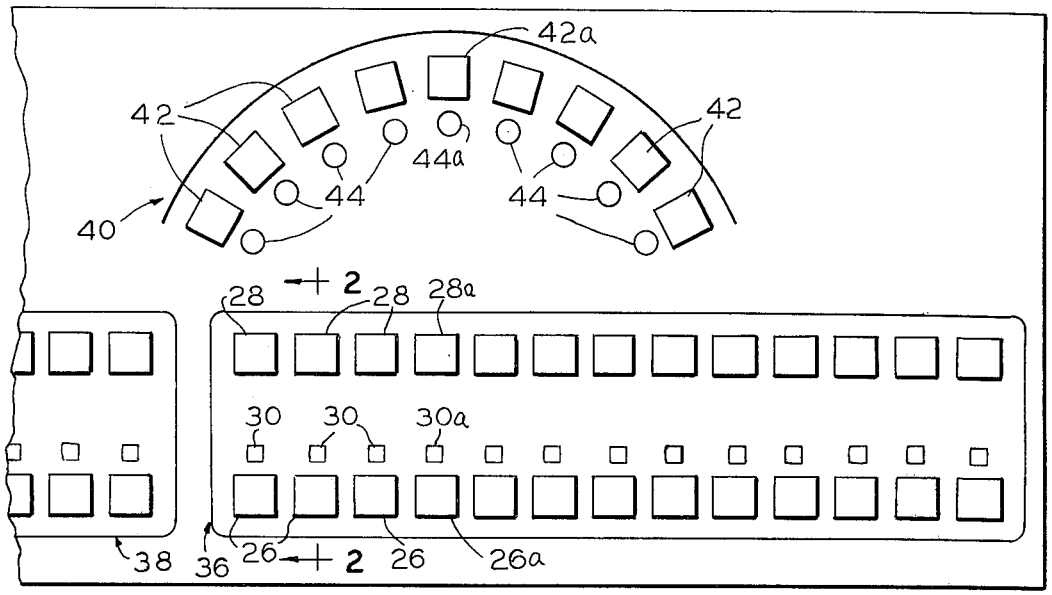
FIG. 1 is a top view of a portion of an organ stop switching system panel according to the present invention.
Figure 2:
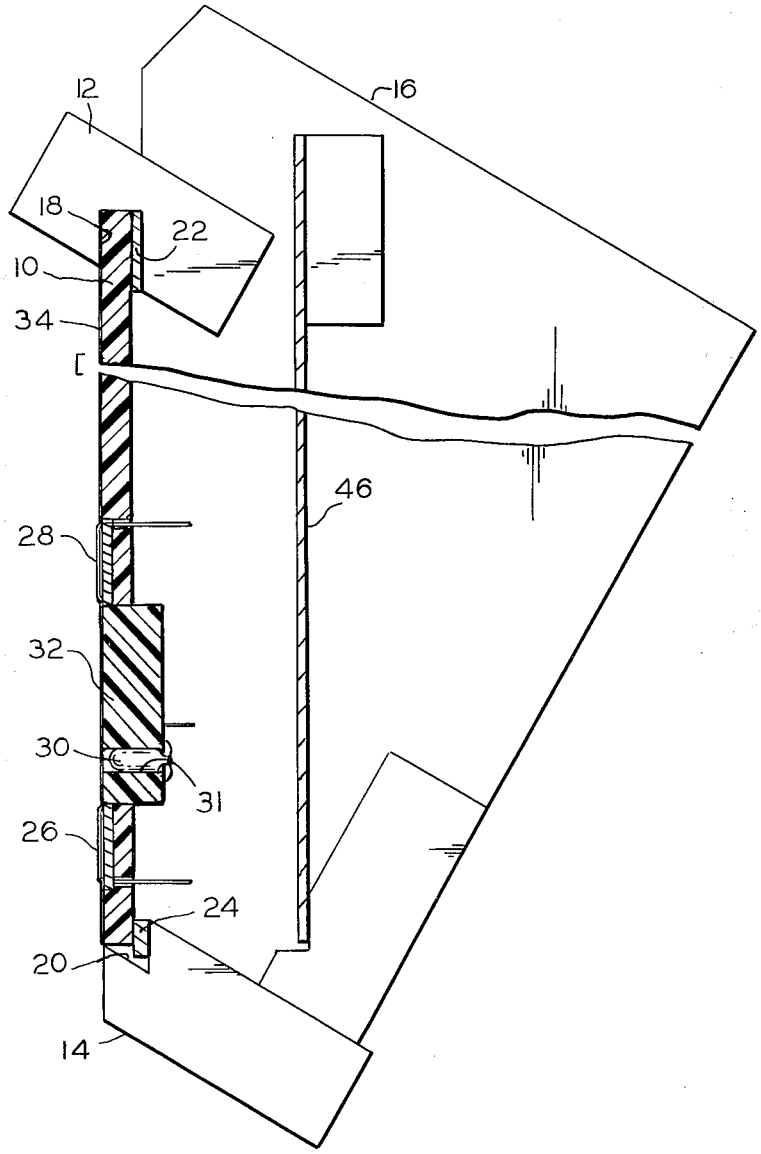
FIG. 2 is a cross sectional view of the FIG. 1 panel, partially broken away, and illustrating mounting structure.

Referring to the drawings and particularly to FIGS. 1 and 2, a flat panel 10 formed of plastic or metal is adapted for mounting on the upper portion of an organ console, above the organ keyboards or manuals, by means of upper and lower mounting brackets 12 and 14 which receive and support the panel. Brackets 12 and 14 are in turn positioned on structural members 16 secured within the organ cabinet. Brackets 12 and 14 are respectively provided with slots 18 and 20 within which panel 10 is received for bearing against pads 22 and 24.

Panel 10 includes first switches 26 arranged in a first horizontal row and a second plurality of switches 28 disposed thereabove in a second horizontal row. The adjacent switches from each row form a pair, for example switches **26*a* and 28*a*, for controlling the on and off position of a given organ stop. The panel includes the switches in inset relation. In between the rows of switches are located indicator lamps 30 which inform the observer whether the particular organ stop is actuated. For instance, indicator lamp 30*a* will, if illuminated, indicate that the particular organ stop controlled by switches 26*a* and 28*a* is in an on or actuated condition. The switches 26 and 28** are suitably touch sensitive, momentary contact switches provided with a front movable plastic membrane including conductive material, which membrane completes a circuit between two adjacent, spaced contacts thereunder, when the membrane is depressed. Suitable switches are manufactured by Centralab Electronics, Milwaukee, Wisconsin, and are of the type employed with model MK1200 keyboards. Although pressure sensitive switches of this type are preferred, capacitive switches or switches wherein the human body completes a circuit between printed conductive patterns may alternatively be employed.

Between a pair of switches 26 and 28, a translucent plastic block 32 is received in the panel 10 in inset relation for supporting indicator lamps 30 in apertures extending through the block to the front surface thereof. If desired, this plastic block may be provided with background lighting by further illumination means, not shown. The panel is further overlaid by a Mylar "skin" 34 which provides a substantially flat overall front surface for the panel.

The aforementioned switches are suitably disposed in groups such as groups 36, 38 and 40 according to the keyboard or function controlled thereby. For example, grouping 36 may comprise the stops for the solo keyboard or manual while grouping 38 comprises the stops for the accompaniment keyboard or manual. A further grouping 40 of switches 42 comprises the control for a transposer as hereinafter more fully described, etc. Switches 42 are suitably arranged in a semi-circular configuration on panel 10, and each is provided with an indicator lamp 44 thereadjacent for indicating the switching condition of the transposer. For example, switch 42*a* is operated for "zero" transposition and when switch 42*a* is depressed, lamp 44*a* will become illuminated for indicating this condition. Depression of switches 42 to the left of switch 42*a* provides a successively more flat transposition, while depression of switches 42 to the right of switch 42*a* brings about a successively more sharp transposition, and in each case the lamp adjacent the depressed switch will become illuminated while the previously illuminated lamp will go out. The switches 42 and lamps 44 are suitably substantially the same as switches 28 and lamps 30 hereinbefore described. The various switches as well as the indicator lamps connect to the circuitry provided on circuit board 46 located behind panel 10.

Figure 3:
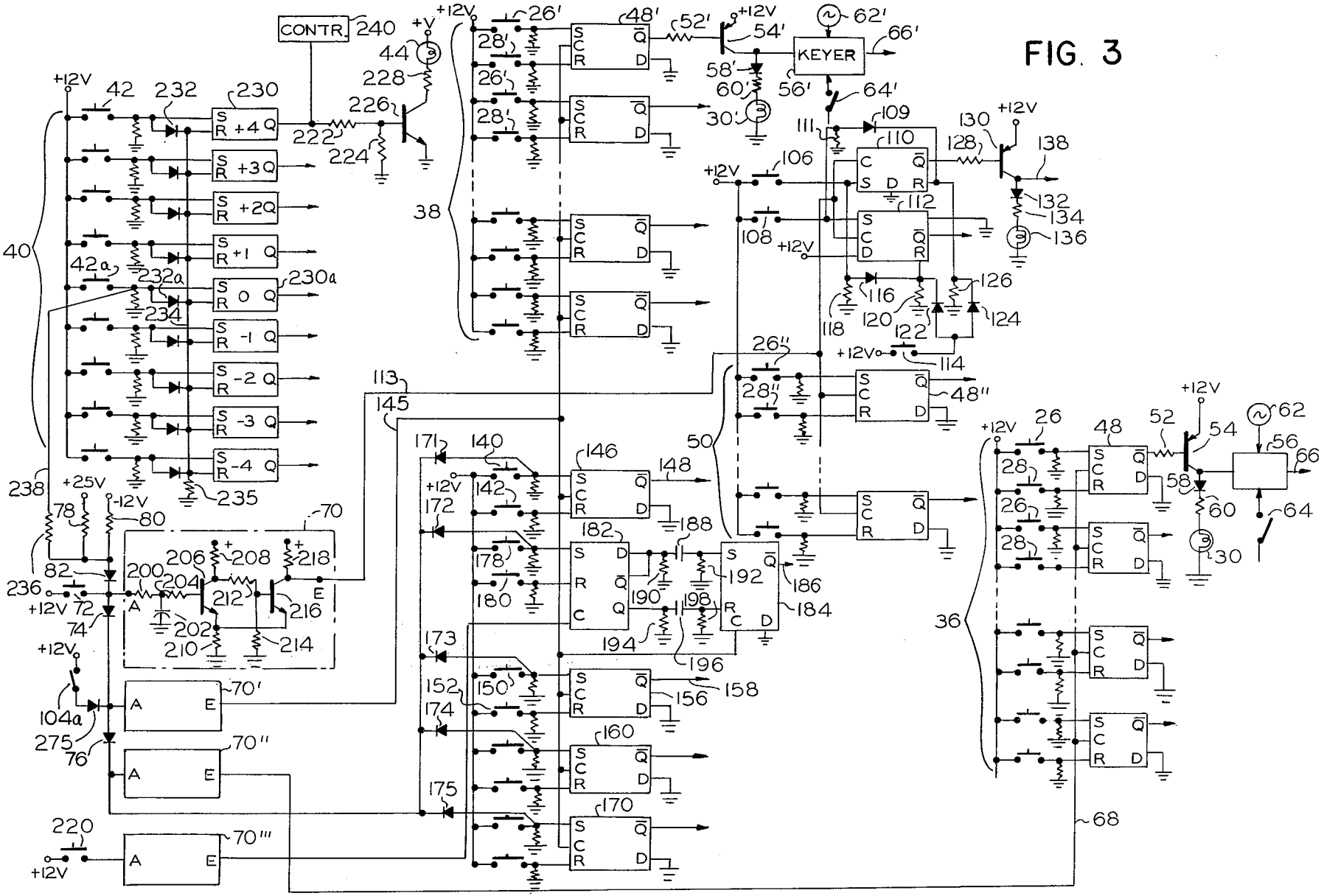
FIG. 3 is an electrical schematic diagram of an organ stop switching system according to the present invention.

Referring to FIG. 3, circuitry is illustrated for pairs of switches 26, 28 of a first group 36, pairs of switches 26', 28' for a second group 38, and pairs of switches 26'', 26'' for a third group 50. Further illustrated is a transposer grouping of switches 42, as well as switching for various other functions to be hereinafter more fully described.

The switches 26 and 28 of each pair are connected respectively to the set and reset inputs of a latching circuit 48, and function, when depressed, to provide +12 volts to the respective set and reset terminals of the latching circuit for placing the latching circuit respectively in the set or reset condition. The Q output of a latching circuit is coupled via resistor 52 to the base of PNP transistor 54, the emitter of which is connected to +12 volts. The collector of transistor 54 is connected to operate a keyer 56 or other switched device as well as an indicator lamp 30 through the series combination of diode 58 and resistor 60, the remaining terminal of lamp 30 being grounded. Keyer 56 receives the output of various oscillators, one of which is represented at 62, and an indication from various organ keys, one of which is represented at 64, while an appropriate audio signal is supplied at 66 in accordance with the stop selected and the key depressed. This type of circuitry is, of course, also associated with the outputs of the remaining latching circuits 48.

A further input to each of the latching circuits 48 comprises the clock input, designated C, which is supplied on lead 68 from Schmitt circuit 70''. Circuit 70'' in turn receives an input when general cancel switch 72 is depressed, for coupling a +12 volts via diodes 74 and 76 to terminal A thereof whereby a positive output pulse is supplied on line 68. This pulse causes all the latching circuits 48 in the group 36 to return to a reset condition. Switch 72 is suitably a conventional "piston" operated switch, or alternatively may be of the same type as switches 26 and 28, and is also located on panel 10. The circuits for switches 26', 28' and latching circuits 48' in group 38, as well as the switches 26'', 28'' and latching circuits 48'' in group 50, are substantially the same as the circuitry employed for group 36. Group 50 may comprise circuitry for general organ stops.

Figure 4:
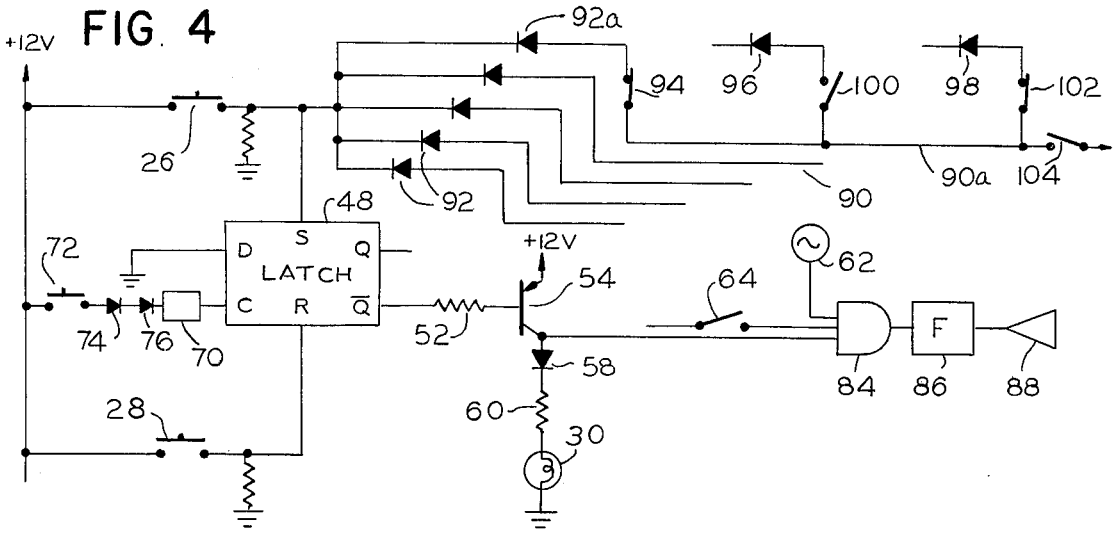
FIG. 4 is a schematic diagram further illustrating a typical portion of the FIG. 3 circuit.

Referring more particularly to FIG. 4, wherein the latching and output circuitry, e.g. as associated with an organ manual stop, is illustrated in greater detail, the latching circuit 48 suitably comprises one half of a type CD4013A integrated circuit chip "D" type flip-flop with set-reset capability available from RCA. Two stop controls can be accommodated per chip. The set, reset, clock and Q terminals are connected as indicated hereinbefore, and the data terminal, D, is grounded in this instance. In addition to the set terminal's receiving an input from switch 26, a further input is suitably provided to each set terminal of each latching circuit 48 from a plurality of preset busses 90 via diodes 92. A given preset bus, for example preset bus 90*a*, is coupled to the anode of the diode 92*a* by way of a switch 94, and is also coupled to the anodes of diodes 96 and 98 via switches 100 and 102 respectively, wherein the cathodes of these diodes are connected to set terminals of other latching circuits, either in the same group or other groups. The preset combination of stops can be preselected by closing certain of the switches leading from the preset bus, for example in the illustration given, switches 94 and 102 are closed while switch 100 is open. Then, when the combination "stored" on switches 94, 100 and 102 is desired, switch 104 is closed for connecting preset bus 90*a* to a source of voltage whereby latches associated with switches 94 and 102 will be set. Thus, the organist need only close switch 104 to select a preset combination, rather than closing a plurality of switches 26, one for each stop. Although the preset combination is herein illustrated as being "stored" on a plurality of switches 94, 100 and 102, it is understood that such storage may employ memory elements such as set forth in U.S. Pat. No. 3,497,714 granted Feb. 24, 1970, to Patrick M. Castle and assigned to the assignee of the present invention.

The function of a keyer is illustrated schematically in FIG. 4 wherein and-gate 84 receives one input from the collector of transistor 54, a second input from oscillator 62 and a third input from organ key 64. Thus, if a given latch 48 is in the set condition, indicating the operation of a stop, its Q output will be low causing transistor 54 to conduct. Consequently, the output of its collector will be high for applying a first input to and-gate 84. If an organ key 64 is depressed, and-gate 84 will pass an audio signal from oscillator 62 to a filter 86 adapted to provide the tonal quality designated for this particular organ stop. The output of filter 86 is coupled to sound amplification and reproducing means 88. When transistor 54 is turned on, current is supplied through diode 58 and resistor 60 to indicator lamp 30, thereby indicating the set condition of the latch 48 and the actuated condition of the organ stop.

Various other groups of touch sensitive switches are also suitably included on the organ panel. Referring again to FIG. 3, a pair of switches 106 and 108 is employed as a tremulant control in conjunction with an off switch 114. Switches 106 and 108 are utilized respectively for setting latching circuits 110 and 112, wherein the Q output of latching circuit 110 drives PNP transistor 130 by way of coupling resistor 128. The emitter of transistor 130 is connected to a +12 volts and its collector is coupled to one terminal of indicator lamp 136 through the series combination of diode 132 and 134, the remaining terminal of the indicator lamp being grounded. Output lead 138 is employed to turn on the desired tremulant modulation of the organ oscillators, for example as may be designated for a delayed tremulant. The Q output of latching circuit 112 is suitably connected to a similar circuit which may be designated as initiating a fast tremulant. As can be seen, the latching circuits 110 and 112 provide their respective outputs in the alternative. Switch 106 when depressed applies a +12 volts to the set terminal of latching circuit 110 for setting the same, and at the same time applies a +12 volts to reset terminal of latching circuit 112 by way of diode 116, the anode of which is returned to ground through resistor 118. Also, operation of switch 108 applies a +12 volts to the set terminal of latching circuit 112, and to the reset terminal of latching circuit 110 through diode 109, the anode of which is returned to ground through resistor 111. Both latching circuits 110 and 112 can be returned to the reset condition by depression of switch 114 which places the +12 volt level on the reset terminals of both latching circuits 110 and 112 through diodes 124 and 122, the cathodes of which are returned to ground by resistors 124 and 122. Circuit 110 is returned to reset and circuit 112 is returned to set by a pulse on lead 113 from Schmitt circuit 70, in conjunction with the resetting of the latching circuits of group 50, as when general cancel switch 72 is actuated, or the organ is initially turned on. It is noted the D terminal of circuit 110 is grounded while the D terminal of circuit 112 connects to +12 volts. Switches 106, 108 and 114 are suitably of the same type as switches 26 and 28 while the latching circuits, indicator lamps, etc. are also of the same kind as hereinbefore described.

A further group of switches including switches 140 and 142 is employed to control percussion stops wherein switch 140 applies voltage to the set terminal of latching circuit 146 for providing an output on lead 148 to appropriate circuitry in the organ. Switch 142 connects the same voltage to the reset terminal of latch circuit 146. Similarly, switches 150 and 152 operate latching circuit 156 which supplies an output on lead 158. Further switches in the same group operate latching circuits 160 and 170 to a similar end. The switches are suitably touch sensitive switches as hereinbefore described. The percussion circuitry is known by those skilled in the art and will not be described herein. The latching circuits 146, 150, 160 and 170 may be reset from the output on lead 145 from Schmitt circuit 70′ in conjunction with the latching circuits of group 38.

A further group of switches comprises switches 178 and 180 which are adapted to supply a +12 volts to the set and reset terminals of latching circuit 182. The Q output of latching circuit 182 is coupled to the set input of latching circuit 184 by coupling means comprising series capacitor 188 the terminals of which are returned to ground through resistors 190 and 192. Also, the Q output of latching circuit 182 is connected to the D input to provide a toggle function. Furthermore, the Q output of latching circuit 182 is coupled to the reset input of latching circuit 184 by means of capacitor 196 having its respective terminals returned to ground through resistors 194 and 198. The clock terminal of latching circuit 184 is connected to lead 145 from Schmitt circuit 70′ so circuit 184 will be reset concurrently with the percussion latching circuits of group 38, the D terminal of latching circuit 184 being connected to ground. The output on lead 186 is suitably applied as a grand piano stop control, e.g. for causing the organ tone generation circuitry to provide terminated, piano-like notes. The piano stop control is reversible, in accordance with the circuit described, by means of toe stud 220 which comprises a foot operated switch for applying a +12 volts to the input, A of Schmitt circuit 70‴. The output of Schmitt circuit 70‴ is connected to the clock input of latching circuit 182, and since the latter is connected as a toggle, each pulse on the clock input thereof causes a reversal in the Q and Q outputs of the latching circuit. These outputs are differentiated by the intervening capacitors 188 and 196 whereby set and reset signals are successively applied to latching circuit 184 for changing its state with successive closing of switch 220. Latching circuits 146, 150, 160, 170, 182 and 184 may be of the same general type as latching circuit 48. Switches 178, 180 may also be of the type described above.

Each of the Schmitt circuits 70, 70′, 70″ and 70‴ are substantially identical, and only circuit 70 will be described in detail. Circuits 70, 70′ and 70‴ operate simultaneously when general cancel switch 72 is closed. Furthermore, when the organ is turned on, a positive voltage at the midpoint of voltage divider 78, 80 operates circuits 70, 70′, 70″, via diode 82, since the +25 volt supply comes up to voltage faster than the −12 volt power supply. Also when switch **104*a* is closed, as selectively operated in sequence while switch 104 in FIG. 4 continues to be operated, circuits 70′ and 70″ are energized via diode 275 to reset manual stops not associated with a new combination. Switches 104 and** 104*a* may employ the same physical actuator. Schmitt circuit 70″ receives additional inputs via diodes 171 through 175 from the "on" switches 140, 178 and 150 and the other "on" switches associated with the precussion group. Therefore, whenever one of the percussion stops is operated, the solo stop latching circuits are returned to a reset condition. Referring to Schmitt circuit 70 in FIG. 3, one terminal of general cancel switch 72, as well as the cathode of diode 82 and the anode of diode 74 are connected to terminal A which is coupled via a series connection of resistors 200 and 204 to the base of NPN transistor 206. A capacitor 202 is shunted from a midpoint between the resistors to ground. The transistor 206 is connected to a positive voltage through resistor 208 and to the base of NPN transistor 216 by way of coupling resistor 212, while the base of transistor 216 is returned to ground through resistor 214. A common emitter resistor 210 is interposed between the emitters of transistors 206 and 216 and ground. The collector of transistor 216 is connected to a positive voltage through resistor 218, and is also connected to output terminal E of circuit 70. When general cancel switch 72 is operated, a positive voltage is applied through resistor 200 to capacitor 202 for charging the latter. Transistor 206, normally nonconducting, is rendered conducting and the output thereof switches transistor 216 to a nonconducting condition. As a consequence, the voltage at terminal E rises, providing a sharp voltage step on line 113. The state of the circuit, with transistor 206 and transistor 216 nonconducting, is retained for a brief period until cancel switch 72 is no longer depressed and capacitor 202 discharges.

The transposer control grouping 40 in FIG. 3 includes the plurality of touch sensitive switches 42 wherein a first terminal of each switch is connected to a +12 volts and a second terminal of each switch is connected to the set terminal of a latching circuit 230. The latching circuit 230 suitably comprises one fourth of a type CD4043A integrated circuit chip available from RCA. Thus, four latching circuits 230 can be accommodated on one chip. The same terminal of each switch 42, which is connected to the set terminal of the latching circuit, is also coupled to the reset terminal thereof through a diode 232, the anode of which is connected to said reset terminal. Furthermore, a common bus 234 joins the cathodes of all the diodes 232 and the bus is returned to ground via resistor 235.

When the organ is initially turned on, the voltage at the midpoint of a voltage divider comprising resistor 78 and 80 is applied via resistor 236 to the terminal of switch 42*a* coupled to the set terminal of latching circuit 230*a*. This voltage is effective for setting the "zero" transposition latching circuit 230*a* since the voltage reaching its set terminal is greater than the voltage reaching its reset terminal via diode 232*a*, as a result of the voltage drop across the latter. However, such voltage on the reset terminal of latching circuit 230*a* is also applied to the reset terminals of the other transposer latching circuits 230, causing all the remaining latching circuits to switch to a reset condition. After the organ is operating, the depression of any switch 42 will cause the latching circuit to which it is connected to switch to a set condition, while all the other latching circuits are switched to a reset condition by way of the diode 232 connected to the depressed switch, and bus 234 connected to the remaining latching circuits. Depression of switch 42*a* will, of course, return latching circuit 230*a* to a set condition and the remaining latching circuits to the reset condition. It will be seen that only one of the latching circuits is in a set condition at any one time.

The terminal Q of each latching circuit 230 is coupled to a separate output circuit, only one of which is illustrated for convenience. This output circuit includes a resistor 222 coupling the aforementioned Q terminal to the base of NPN transistor 226 having its emitter returned to ground and its base returned to ground through resistor 224. The collector of transistor 226 is connected by resistor 228 to one terminal of indicator lamp 44 which is physically located adjacent the switch 42 on panel 10 operating the latching circuit 230 energizing the corresponding transistor 226. The remaining terminal of lamp 44 is connected to a positive voltage. Consequently, as long as the given latching circuit 230 is in a set condition, the lamp 44 adjacent the switch 42 responsible for the setting thereof will remain illuminated. Also, the Q output of a latching circuit 230 is connected to a control 240, hereinafter more fully described, for bringing about transposition of notes in the organ. In FIG. 3, the latching circuits 230 designated +1, +2, +3 and +4 bring about successively sharper transposition, while the latching circuits 230 designated −1, −2, −3 and −4 bring about successively more flat transposition.

Figure 5:
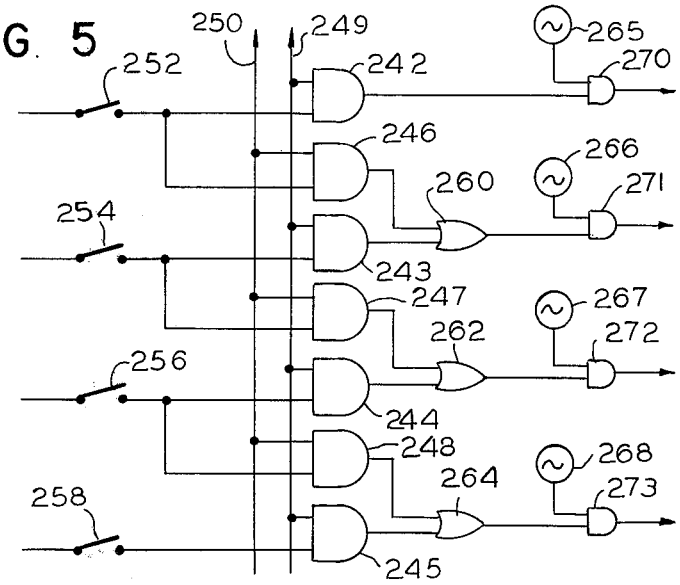
FIG. 5 is a schematic diagram further illustrating an example of one type of transposer circuit.

Referring to FIG. 5, a further control portion 240 of a type of transposer circuit is illustrated, wherein leads 249 and 250 represent outputs of a pair of adjacent latching circuits 230 in FIG. 3. Specifically, lead 249 is the output of latching circuit 230*a*, and lead 250 is the output of an adjacent latching circuit. It is understood the circuit is further expanded to accommodate the full range of transposition. Organ keys are represented by switches 252, 254, 256 and 258 which selectively provide energization to and-gates 242-245, normally enabled (for zero transposition) by lead 249. The output of and-gate 242 enables and-gate 270 which also receives an audio signal from oscillator 265 representing a given note of the scale. The output of and-gate 270 is then supplied to the amplification and sound reproducing portions of the organ. Similarly, if key switch 254 is depressed, the output of and-gate 243 enables and-gate 271 via or-gate 260 for providing an output from oscillator 266 representing the next note of the scale. Also, if key switch 256 is depressed, and-gate 244 enables and-gate 272 via or-gate 262 for passing the output of oscillator 267 for providing the next scale note, and if key switch 258 is depressed, and-gate 245 energizes and-gate 273 by way of or-gate 264 for coupling the output of oscillator 268, for the next note of the scale in order, to the amplification and reproduction portion of the organ. However, a transposition may be desired whereby key switch 252 is to "play" oscillator 266 rather than oscillator 265, key switch 254 is to "play" oscillator 267 rather than oscillator 266, and key switch 256 is to "play" oscillator 268 rather than oscillator 267. For this purpose, the circuitry of FIG. 3 is switched to provide a signal on lead 250 instead of lead 249 as by the energization of a next latching circuit 230 in order. Then, and-gates 246, 247, 248 will be enabled, to which key switches 252, 254 and 256 are respectively connected, and key switch 252 can enable and-gate 271 by way of or-gate 260 to which the output of and-gate 246 is also connected. Also, key switch 254 can enable and-gate 272 through or-gate 262 to which the output of and-gate 247 is also coupled, and key switch 256 can enable and-gate 273 by way of or-gate 264 to which the output of and-gate 248 is also connected. When and-gates 246–248 are energized, and-gates 242–245 are deenergized. The FIG. 5 circuit merely illustrates one type of transposer circuit which may be employed, and is shown and described for the purpose of illustrating the transposer function, it being realized that other circuitry for accomplishing transposition may be substituted therefor.

While the switches associated with organ stops, as well as the latching circuits operated thereby for bringing about an organ stop condition until reset, are illustrated herein as pertaining to particular groups for particular manuals or functions, it will be realized that the stops of an organ and the switching therefor may be organized in other groupings, or in a lesser or greater number of groupings, as desired. Furthermore, while a relatively small number of switches and latching circuits are illustrated herein as pertaining to each grouping for the purpose of facilitating disclosure and a clear understanding of the system, the dashed leads between switches and latching circuits normally indicate the usual interposition of a greater number of switches and latching circuits operated thereby. However, the number of switches and latching circuits in a given group for a given manual or function will be dependent upon the particular requirement for a particular organ.

While we have shown and described a preferred embodiment of our invention, it will be apparent to those skilled in the art that other changes and modifications may be made without departing from our invention in its broader aspects. We, therefore, intend the appended claims to cover all such changes and modifications as fall within the true spirit and scope of our invention.

We claim

1. A stop control system for an organ comprising:

a plurality of latching circuits associated respectively with individual organ stops and adapted to energize circuitry for affecting the tonal quality of the organ in accordance with the latching circuit state, a panel for mounting on an organ console, said panel including a plurality of touch sensitive switches disposed in groups associated with given organ manuals or functions, said touch sensitive switches being disposed in pairs connected respectively for setting and resetting a corresponding latching circuit for operating each designated organ stop, and indicating lamps responsive to respective conditions of each of said latching circuits for indicating the state of each latching circuit and corresponding organ stop, wherein an indicating lamp responsive to a given latching circuit is disposed in said panel in proximity to the pair of touch sensitive switches employed for operating the given latching circuit.

2. A stop control system for an organ comprising:

a plurality of latching circuits associated respectively with individual organ stops and adapted to energize circuitry for affecting the tonal quality of the organ in accordance with the latching circuit state, a panel for mounting on an organ console, said panel including a plurality of touch sensitive switches disposed in groups associated with given organ manuals or functions, said touch sensitive switches being disposed in pairs connected respectively for setting and resetting a corresponding latching circuit for operating each designated organ stop, indicating lamps responsive to respective conditions of each of said latching circuits for indicating the state of each latching circuit and corresponding organ stop, wherein an indicating lamp responsive to a given latching circuit is disposed in proximity to the pair of touch sensitive switches employed for operating the given latching circuit, and a cancel circuit at least coupled to latching circuits operated by a said group of switches for simultaneously switching the last mentioned latching circuits to a given condition.

3. The system according to claim 2 further including transposer control means comprising:

a plurality of second latching circuits each adapted to bring about a given transposition of notes in said organ, a plurality of further touch sensitive switches, each associated with one of said second latching circuits for operating the same for changing the state thereof from a first condition to a second condition, said panel also including said plurality of further touch sensitive switches, a further plurality of indicating lamps respectively energized by one of said second latching circuits, wherein an indicating lamp energized by a given second latching circuit is disposed in said panel adjacent the touch sensitive switch for operating the same latching circuit, coupling means between each further touch sensitive switch and the remaining second latching circuits not operated thereby for resetting the remaining second latching circuits, and means for operating a predetermined second latching circuit upon energization of said organ.

4. The system according to claim 2 further including circuit means responsive to operation of touch sensitive switches in a first group thereof for switching latching circuits in a second group to a predetermined condition.

5. The system according to claim 2 further including an additional latching circuit intermediate a given pair of switches and a given latching circuit for operating a given stop, and further switching means for reversing the condition of said additional latching circuit for providing a reversing input to said given latching circuit.

6. The system according to claim 2 further including selectively energizable preset busses coupled to predetermined combinations of said latching circuits for simultaneously changing the state of a selected combination of latching circuits.

7. The system according to claim 6 further including means for resetting latching circuits not included in said combination.

8. A stop control system for an organ comprising:

a plurality of latching circuits associated respectively with individual organ stops and adapted to energize circuitry for affecting the tonal quality of the organ in accordance with the latching circuit state, a panel for mounting on an organ console, said panel including a plurality of touch sensitive switches disposed in groups associated with given organ manuals or functions, said such sensitive switches being disposed in pairs connected respectively for setting and resetting a corresponding latching circuit for operating each designated organ stop, and indicating lamps responsive to respective conditions of each of said latching circuits for indicating the state of each latching circuit and corresponding organ stop, wherein an indicating lamp responsive to a given latching circuit is disposed in said panel in proximity to the pair of touch sensitive system empolyed for operating the given latching circuit, said panel being substantially flat and including said touch sensitive switches in inset relation, said panel also including apertures within which said indicating lamps are received, said panel being overlaid by a common surface layer providing a substantially flat overall front surface for the panel through which said switches are operated by touch of said layer and through which said indicating lamps are observed.

* * * * *

UNITED STATES PATENT AND TRADEMARK OFFICE

CERTIFICATE OF CORRECTION

PATENT NO. : 4,023,457

DATED : May 17, 1977

INVENTOR(S) : Kirkwood et al

It is certified that error appears in the above-identified patent and that said Letters Patent are hereby corrected as shown below:

In the references: "Lerio" should be --Iorio--; "Derrt" should be --Derry--.

Column 3, line 36, "26'''", second occurence, should read --28''--. Column 3, line 45, "Q" should read --$\overline{Q}$--. Column 4 line 16, "Q" should read --$\overline{Q}$--. Column 4, line 50, "Q" should read --$\overline{Q}$--. Column 4, line 68, "Q" should read --$\overline{Q}$--. Column 5, line 9, "Q" should read --$\overline{Q}$--. Column 5, line 57, "Q" should read --$\overline{Q}$--. Column 5, line 62, "Q" should read --$\overline{Q}$-- Column 6, line 2, after the word "circuits" insert --and the latching circuit--. Column 6, line 14, "Q", second occurrence should read --$\overline{Q}$--. Column 6, line 25, "70'''" should read --70''--. Column 6, line 40, "precussion" should read --percussion--. Column 10, lines 49 and 50, "system empolyed" should read --switches employed--.

Signed and Sealed this

*Twenty-fourth* Day of *October 1978*

[SEAL]

*Attest:*

RUTH C. MASON
*Attesting Officer*

DONALD W. BANNER
*Commissioner of Patents and Trademark*